US008161607B2

(12) United States Patent
Hirai et al.

(10) Patent No.: US 8,161,607 B2
(45) Date of Patent: Apr. 24, 2012

(54) METHOD FOR OPENING FABRIC, FABRIC, AND COMPOSITE MATERIAL

(75) Inventors: Masaaki Hirai, Joetsu (JP); Akihiko Machii, Joetsu (JP)

(73) Assignees: Arisawa Mfg. Co. Ltd., Niigata (JP); Toho Tenax Co., Ltd., Tokyo (JP)

( * ) Notice: Subject to any disclaimer, the term of this patent is extended or adjusted under 35 U.S.C. 154(b) by 175 days.

(21) Appl. No.: 12/671,306

(22) PCT Filed: Aug. 6, 2008

(86) PCT No.: PCT/JP2008/064144

§ 371 (c)(1),
(2), (4) Date: Jan. 29, 2010

(87) PCT Pub. No.: WO2009/022609

PCT Pub. Date: Feb. 19, 2009

(65) Prior Publication Data

US 2010/0186847 A1 Jul. 29, 2010

(30) Foreign Application Priority Data

Aug. 10, 2007 (JP) ..... 2007-209593

(51) Int. Cl.
*D06C 29/00* (2006.01)

(52) U.S. Cl. ..... 28/165; 26/27; 139/383 R

(58) Field of Classification Search ..... 28/165, 28/171, 282, 132, 140, 100; 26/51, 25, 26, 26/27; 139/383 R, 420 R, 426 R
See application file for complete search history.

(56) References Cited

U.S. PATENT DOCUMENTS 3,961,115 A * 6/1976 Klein ..... 428/88
4,078,323 A * 3/1978 Baumgarten ..... 38/44
5,396,932 A * 3/1995 Homma et al. ..... 139/420 A
5,511,395 A 4/1996 Hamade et al.
5,557,831 A * 9/1996 Kishi et al. ..... 28/167
5,732,748 A * 3/1998 Aucagne et al. ..... 139/383 R
5,783,278 A * 7/1998 Nishimura et al. ..... 428/102
(Continued)

FOREIGN PATENT DOCUMENTS

EP 0302449 A2 2/1989
(Continued)

OTHER PUBLICATIONS

Supplementary European Search Report in Application No. 08827468.3, dated Jun. 1, 2011.
(Continued)

*Primary Examiner* — Amy Vanatta
(74) *Attorney, Agent, or Firm* — Sughrue Mion, PLLC

(57) ABSTRACT

According to the present invention there is provided a method for opening a fabric, in which warp and weft yarns can be uniformly opened using a simple method without having to alter the fabric weaving procedure. The method is a method for opening a fabric (4) produced by weaving a warp yarn (2) and a weft yarn (3), each of which having a bundled plurality of fiber filaments (1). A contact body (6) is provided to a surface of the fabric (4) with a protective film (5) interposed therebetween, and the contact body (6) is caused to move over the fabric (4) obliquely, and in a relative manner, with respect to the longitudinal direction of the warp yarn (2) or the weft yarn (3), whereby the warp yarn (2) or the weft yarn (3) is spread.

9 Claims, 9 Drawing Sheets

U.S. PATENT DOCUMENTS

| | | | | |
|---|---|---|---|---|
| 6,032,342 | A * | 3/2000 | Kawabe et al. | 28/283 |
| 6,195,854 | B1 * | 3/2001 | Catallo | 26/27 |
| 6,637,084 | B2 * | 10/2003 | Dischler | 26/28 |
| 7,138,345 | B2 * | 11/2006 | Wadahara et al. | 442/179 |
| 7,779,870 | B2 * | 8/2010 | Homma et al. | 139/420 R |
| 2006/0252325 | A1 | 11/2006 | Matsumura | |
| 2007/0023099 | A1 | 2/2007 | Homma | |
| 2011/0171452 | A1 * | 7/2011 | Ottinger et al. | 428/221 |

FOREIGN PATENT DOCUMENTS

| | | | |
|---|---|---|---|
| FR | 2478693 | A1 | 9/1981 |
| JP | 2307965 | A | 12/1990 |
| JP | 08-232135 | A | 9/1996 |
| JP | 2001-316971 | A | 11/2001 |
| JP | 2003-268669 | A | 9/2003 |
| JP | 2004-137623 | A | 5/2004 |
| JP | 2005-290623 | A | 10/2005 |

OTHER PUBLICATIONS

International Search Report mailed on Nov. 11, 2008 (4 pages).

International Preliminary Report on Patentability dated Mar. 18, 2010 (7 pages).

* cited by examiner

FIG. 13

| | | Working Ex. 1: Eccentric movement | Working Ex. 2: ±45° reci-procating movement | Comp. Ex. 1: Fabric not opened | Comp. Ex. 2: Fabric opened with ultrasound |
|---|---|---|---|---|---|
| Fabric | Cover factor (%) | 97-100 | 97-100 | 86-89 | 96-98 |
| | Fluff | ○ | ○ | ○ | × |
| | Handling | ○ | ○ | × | × |
| Compo-site material | Bending strength (MPa) | 1200 | 1150 | 1000 | 1100 |
| | ILSS (Mpa) | 77 | 75 | 68 | 72 |

METHOD FOR OPENING FABRIC, FABRIC, AND COMPOSITE MATERIAL

TECHNICAL FIELD

The present invention relates to a method for opening a fabric, and to a fabric and a composite material.

BACKGROUND ART

A carbon fiber fabric produced by weaving a warp yarn and a weft yarn made of a carbon fiber filament bundle ("fiber bundle" or simply "yarn" hereafter), obtained by bundling a plurality of carbon fiber filaments using a sizing agent, can be composited with a resin to form a composite and thereby reduce weight and increase strength. Such fabrics have accordingly been used widely in the field of aircraft materials. In recent years, there has been demand for the fabrics to be made even lighter while maintaining their strength.

Attempts to attain strength while reducing the amount of yarn (weight per unit area) used in the fabric have been made in order to satisfy such demands for a reduction in weight.

However, merely reducing the weight per unit area results in gaps being formed in the fabric; and, when the fabric is formed into a composite, results in the strength being insufficient and properties being inconsistent.

One method for solving the problem involves spreading each of the individual warp and weft yarns that form the fabric. Specifically, for example, there is disclosed in a patent reference 1 a method in which a jet of air is sprayed to spread the weft yarns (the yarns disposed orthogonal to the direction in which the fabric is conveyed), whereupon a surface of a reinforced fiber fabric being conveyed is subjected to pressure by a roller body that moves reciprocatingly in the longitudinal direction in which the fabric is conveyed (i.e., parallel to the warp yarns), whereby the warp yarns (the yarns disposed parallel to the direction of fabric conveyance) are spread. There is also known a method in which a fabric is immersed in water and opened using, for example, sound waves.

[Patent reference 1] Japanese Laid-open Patent Publication No. 2003-268669

SUMMARY OF THE INVENTION

However, the method disclosed in patent reference 1 comprises use of an air-jet to spread the weft yarns, and therefore upsets the arrangement of the fiber filament bundle, and increases the likelihood of fluff forming or the texture becoming rough. In terms of the fabric itself, the method increases the likelihood that the yarns will break or irregular gaps will be present between the yarns, and the fabric becomes less readily handled.

Also, it is difficult to apply pressure directly to sections where the warp and weft yarns intersect (sections of a yarn that are overlapped by the other yarn) using the roller body, and the yarns are not readily spread in a uniform manner.

Moreover, the fibers of the weft yarns, which are directly pressed by the roller body, are likely to accumulate on a downstream side of the direction in which the base material is conveyed, further preventing a uniformly spread fabric from being obtained.

Additionally, when a roller body is used to spread the yarns, the pressure applied by the roller body is likely to bend the weft yarns towards the direction in which the fabric is conveyed, increasing the likelihood of bowing in the fabric.

Therefore, it is difficult to spread the warp and weft yarns uniformly in a fabric opened using the method disclosed in patent reference 1. Accordingly, a composite material obtained from such a fabric and a resin does not have uniformly arranged weft yarns; therefore, sufficient strength cannot be obtained.

According to the method in which the fabric is immersed in water and opened using, for example, sound waves, a water-soluble constituent of a sizing agent adhering to a fiber bundle is removed during spreading, increasing the likelihood of fluff forming or the texture becoming rough, and reducing handleability. Also, removing the sizing agent, which also functions as a coupling agent, results in decreased adhesive strength between the fabric base material and a matrix (resin) when a composite material is obtained.

The present invention solves the above-mentioned problems, and provides a commercially valuable method for opening a fabric, a fabric, and a composite material, in which warp and weft yarns can be uniformly spread using a simple method without having to alter the fabric weaving procedure, and in which a lightweight and high-strength composite material can be inexpensively obtained using a flat fabric having warp and weft yarns that are uniformly spread without any decrease in handleability or strength of adhesion with the resin.

The main points of the present invention are described below with reference to the attached drawings.

A first aspect of the present invention relates to a method for opening a fabric in which a fabric 4 produced by weaving a warp yarn 2 and a weft yarn 3, each having a bundled plurality of fiber filaments 1, is opened; the method for opening a fabric characterized in that a contact body 6 is provided to a surface of the fabric 4 with a protective film 5 interposed therebetween; the contact body 6 is provided with a contact portion for contacting a surface of the fabric 4 with the protective film 5 interposed therebetween, a protrusion 8 having a convex ridge being provided to the contact portion in an annular configuration; and the contact body 6 is caused to move over the fabric obliquely, and in a relative manner, while being caused to vibrate and rotate in an eccentric fashion, thereby spreading the warp yarn 2 or the weft yarn 3.

A second aspect of the present invention relates to the method for opening a fabric according to the first aspect, characterized in that the contact body 6 is caused to move in a relative manner with respect to the fabric 4.

A third aspect of the present invention relates to the method for opening a fabric according to the second aspect, characterized in that the fabric 4 is conveyed.

A fourth aspect of the present invention relates to the method for opening a fabric according to the first aspect, characterized in that the fiber filament 1 is an inorganic fiber filament 1.

A fifth aspect of the present invention relates to the method for opening a fabric according to the first aspect, characterized in that the inorganic fiber filament 1 is a carbon fiber filament 1.

A sixth aspect of the present invention relates to the method for opening a fabric according to the fourth aspect, characterized in that the fiber filament 1 is an organic fiber filament 1.

A seventh aspect of the present invention relates to a fabric characterized in being opened using the method for opening a fabric according to any of the first through sixth aspects.

An eighth aspect of the present invention relates to the fabric according to the seventh aspect, characterized in having a cover factor of 96% or higher.

A ninth aspect of the present invention relates to a composite material characterized in comprising the fabric according to the eighth aspect being used as a base material, and the base material being impregnated with a resin.

Being constituted as described above, the present invention provides a commercially valuable method for opening a fabric, a fabric, and a composite material, in which warp and weft yarns can be uniformly spread using a simple method without complicating the procedure, and in which a lightweight and high-strength composite material can be inexpensively obtained using a flat fabric having warp and weft yarns that are uniformly spread without any decrease in handleability or strength of adhesion with the resin.

BRIEF DESCRIPTION OF THE DRAWINGS

FIG. 13 is a table showing experimental results; and

DETAILED DESCRIPTION OF PREFERRED EMBODIMENTS

Figure 1:
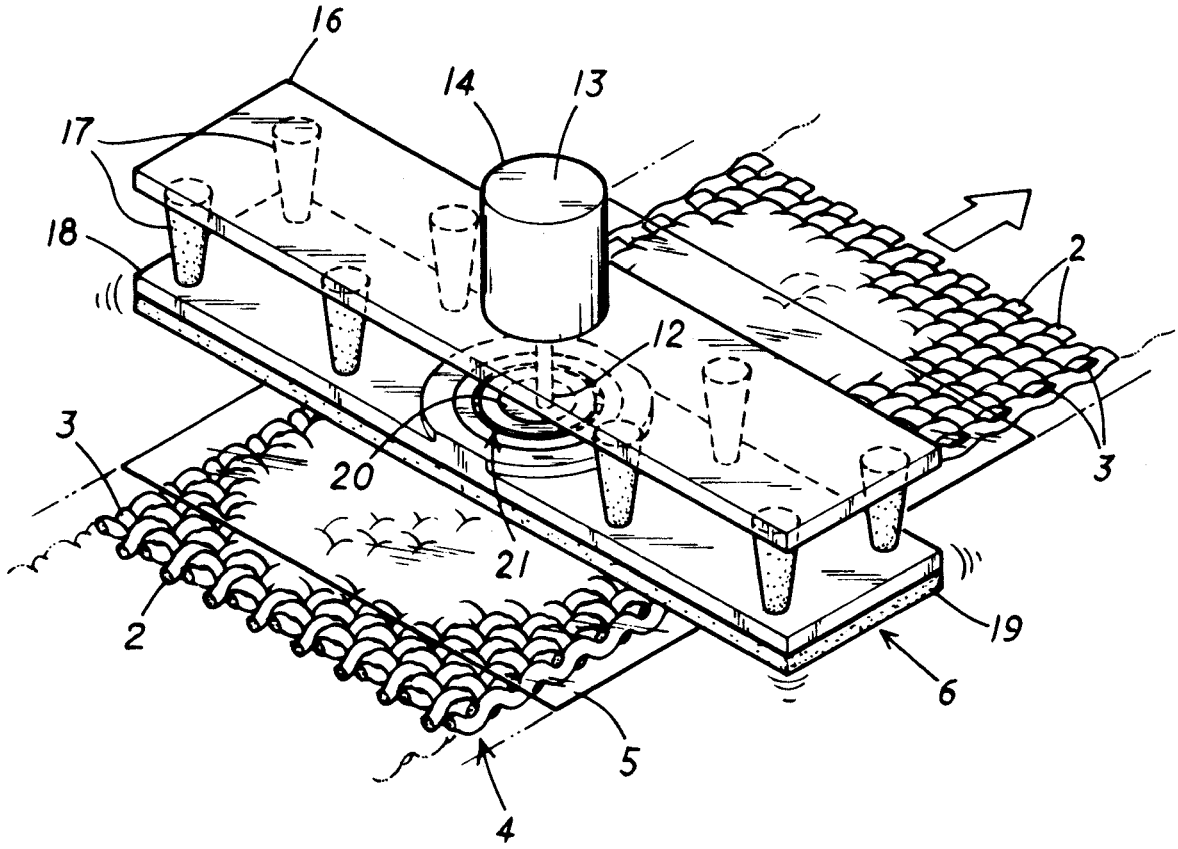
FIG. 1 is a schematic perspective view of a first working example.

Preferred embodiments of the present invention are briefly described below while indicating the effects of the present invention.

A contact body 6 that is caused to contact a surface of a fabric 4 with a protective film 5 disposed therebetween is moved obliquely in the longitudinal direction of a warp yarn 2 or a weft yarn 3. As a result, instead of having pressure applied using a body that travels in a direction parallel to the longitudinal direction of the warp yarn or the weft yarn and merely squeezing the yarns to spread them as, for example, disclosed in the patent reference 1, the warp yarn 2 and the weft yarn 3 are pressed under the application of a force thereon so that each bundle of fiber filaments 1 is pushed and spread, and the yarns spread.

Although a pressing force is necessary to push and spread the bundles of fiber filaments 1, the contact body 6 presses each of the bundles of fiber filaments 1 with the protective film 5 interposed therebetween; therefore, as shall be apparent, the likelihood of damaging the warp yarn 2 and the weft yarn 3 is reduced, and the fabric 4 is not restrained by the contact body 6, thereby allowing the opening step to be performed in a smooth and unhindered manner.

Also, applying a force that pushes and spreads each bundle of fiber filaments 1 allows intersecting regions of the warp and weft yarns, which cannot be pushed and spread directly, to be pushed and spread in concert with the areas next to the intersecting region, and allows the fabric to be opened satisfactorily. In contrast, according to the method disclosed in patent reference 1, the roller body moves reciprocatingly in a direction parallel to the warp yarn; therefore, no force acts on the bundle of fiber filaments 1 so as to push and spread the bundle in an oblique direction, and the intersecting region cannot be opened adequately, as described above.

Since the contact body 6 is moved obliquely in the longitudinal direction of the warp yarn 2 or the weft yarn 3, it shall be apparent that, when disposed obliquely to either one of the warp yarn 2 or the weft yarn 3, the contact body 6 is also disposed obliquely with respect to the other yarn (because normally, the warp yarn 2 and the weft yarn 3 are orthogonal to each other). The warp yarn 2 and the weft yarn 3 can thereby be evenly spread at the same time, and can be spread with a greater degree of uniformity.

Also, the contact body 6 can be readily moved obliquely in the longitudinal direction of the warp yarn 2 or the weft yarn 3 by, for example, having the contact body 6 contact the fabric 4 while being caused to rotate eccentrically, or by having the contact body 6 move reciprocatingly in a direction oblique to a direction in which the fabric 4 is conveyed. The eccentric rotation or the reciprocating movement repeatedly applies a force to push and spread each of the bundle of fiber filaments 1, thereby allowing the yarns to be spread satisfactorily with a smaller pressing force. In particular, when eccentric rotation is used to apply a force to push and spread each of the bundle of fiber filaments 1, the force can be applied uniformly and continuously over a wider area, and an exceptionally high efficiency is obtained.

Also, for example, by causing the contact body 6 to rotate eccentrically against the fabric 4 while vibrating in a compact radial configuration (i.e., in a direction of the surface of the fabric 4), the vibration further improves the quality of the opening process and allows the opening to be performed with exceptionally high efficiency.

Also, a fabric 4 that has been woven using a normal loom can be subjected to the opening process without any intervening steps, eliminating any need to introduce new equipment for, e.g., expanding fibers in each of warp and weft yarns, and the cost is correspondingly reduced. Also, in contrast to methods involving opening the fabric by immersing it in a solvent or another substance, no sizing agent is removed, so that the fabric can be handled as easily as a conventional fabric, and no fluff forms.

Accordingly, the present invention makes it possible to obtain a flat fabric in which the warp and weft yarns are spread uniformly, and makes it possible to obtain a fabric with minimal gaps between yarns. Specifically, when a measuring apparatus such as that disclosed in Japanese Laid-open Patent Publication No. 2005-290623 is used to measure the cover factor (proportion of an area of a fabric that is covered by yarns), the present invention makes it possible to obtain a fabric with a cover factor of 96% or higher. In other words, the surface smoothness of the fabric improves and the thickness decreases.

Working Examples

Working examples of the present invention (first and second working examples) are described below with reference to the drawings.

A first working example is a method for opening a fabric in which a fabric 4 produced by weaving a warp yarn 2 and a weft yarn 3, each having a bundled plurality of fiber filaments 1, is opened. A contact body 6 is provided to a surface of the fabric 4 with a protective film 5 interposed therebetween, and the contact body 6 is caused to move over the fabric obliquely, and in a relative manner, with respect to the longitudinal direction of the warp yarn 2 or the weft yarn 3, thereby spreading the warp yarn 2 or the weft yarn 3.

In the first working example, a fabric 4 in which a carbon fiber filament 1 is used as a fiber filament 1 is opened; however, it is also possible to open a fabric 4 in which filaments of fibers made of glass, alumina, or another inorganic material are used; or a fabric 4 in which filaments of fibers made of aramid, polyallylate, or another organic material are used.

Figure 2:
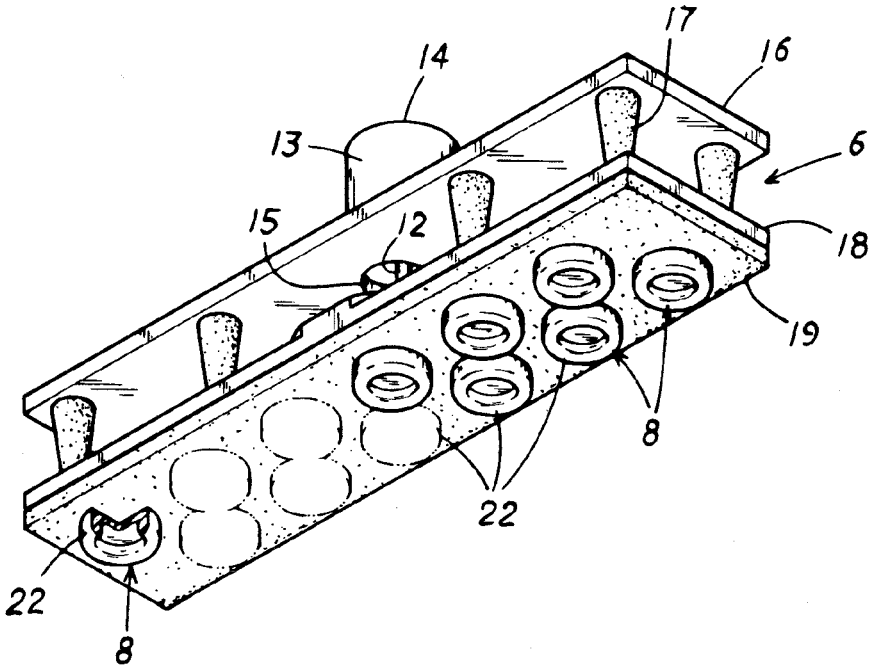
FIG. 2 is a schematic perspective view of a contact body according to the first working example.

In the first working example, a contact body 6 as shown in FIGS. 1 and 2 is used. The contact body 6 is caused to rotate eccentrically against the fabric 4, and thereby opens the fabric by being moved obliquely in the longitudinal direction of the warp yarn 2 or the weft yarn 3 (i.e., in an oblique direction relative to the longitudinal direction). The present working example is configured so that the contact body 6 is brought into contact with an upper surface of the fabric 4; however, the contact body 6 may also be brought into contact with a lower surface of the fabric 4. In an alternative arrangement, a contact body 6 may be provided for the respective upper and lower surface sides of the fabric 4 so that each of the contact bodies 6 is brought into contact with each of the upper and lower surfaces. The efficiency of the opening process is further enhanced particularly when each of the contact bodies 6 is brought into contact with each of the respective upper and lower surfaces of the fabric 4 (at the same portion) while caused to rotate in opposing directions.

Specifically, the contact body 6 is wider than the fabric 4 being conveyed and is configured to be capable of eccentrically rotating in a plane that is substantially parallel to a surface of the fabric 4. The contact body 6 is caused to rotate eccentrically while being pressed with a suitable pressing force against the surface of the fabric 4, the protective film 5 interposed therebetween, whereby the warp yarn 2 and the weft yarn 3 are spread. The principle by which the fabric 4 opens, and the mechanism for causing the contact body 6 to rotate eccentrically, are described further below.

The contact body 6 comprises a metallic upper plate body 16, a metallic lower plate body 18, and a cushioning material 19 made of an elastic body. A motor 14 has a shaft 12 and a motor body 13, the upper plate body 16 being connected to the motor body 13 and having an insertion hole 15 through which the shaft 12 of the motor 14 is inserted. The metallic lower plate body 18 is provided to the upper plate body 16 with a plurality of supporting columns 17 made of elastic bodies interposed therebetween, the metallic lower plate body 18 provided thereto so as to be capable of fine movement. The cushioning material 19 is provided on a lower surface of the lower plate body 18. In the first working example, the upper plate body 16, the lower plate body 18, and caps 22 are made of stainless steel; and the supporting columns 17 and the cushioning material 19 are elastic bodies made of rubber.

A large number of protrusions 8 (caps 22), each having an annular convex ridge, are provided on a contact portion for contacting the surface of the fabric 4 with the protective film 5 made of a resin interposed therebetween, the contact portion being disposed on a lower surface of the cushioning material 19. The protrusions 8 are provided in a zigzag pattern so that each section that contacts the fabric 4 overlaps one another as viewed from the side (the protrusions 8 may be provided in a staggered pattern when three or more rows are provided). In the first working example, a bottom surface of each of the stainless steel caps 22 is adhesively connected to the cushioning material 19. A top portion of each of the protrusions 8 preferably has a radius of about 1 mm to 3 mm. Accordingly, each of the caps 22 is capable of wholly or partially sinking into the cushioning material 19, and flexibly accommodating any unevenness on the surface of the fabric 4.

Numerous hemispherical protrusions, column-shaped protrusions, or other features may instead be arranged on the lower surface of the cushioning material 19; however, the protrusions 8 as described above are particularly suitable because they can uniformly contact the fabric 4 irrespective of the direction of movement and have a wider range of contact than hemispherical or column-shaped protrusions.

Figure 3:
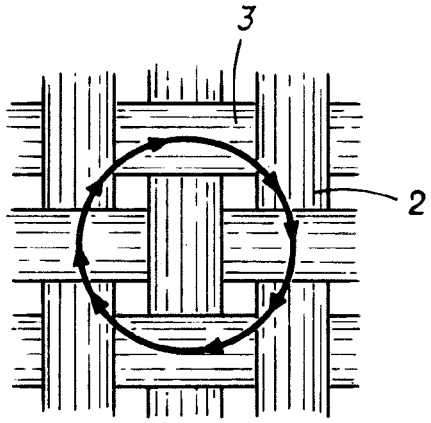
FIG. 3 is a schematic drawing showing a path of movement of a protrusion in the first working example.

The principle by which the protrusions 8 open the fabric 4 will now be described. As described further below, a disc body 20 having a rotating shaft at an eccentric position displaced from a center position rotates and thereby causes the contact body 6 to rotate. Therefore, each of the protrusions 8 provided to the contact body 6 also rotates eccentrically. The eccentrically rotating protrusion 8 follows a circular path as shown in FIG. 3, and the rounded top portion of the protrusion 8 contacts the fabric 4 and moves obliquely in the longitudinal direction of the warp yarn 2 and the weft yarn 3, as also shown in FIG. 3. A bundle of carbon fiber filaments 1 forming the warp yarn 2 and the weft yarn 3 is thereby strongly pushed and spread in an oblique direction. The protrusion 8 obliquely pushes and spreads the warp yarn 2 and the weft yarn 3 in the areas next to intersecting regions of the warp yarn 2 and the weft yarn 3, which makes it possible to correspondingly push and spread the intersecting region (and particularly sections of a yarn that are overlapped by the other yarn). The protrusion 8 continuously moves obliquely in the longitudinal direction of the warp yarn 2 and the weft yarn 3, and uniformly contacts the conveyed fabric 4 across its width direction. It is accordingly possible to uniformly open [the fabric 4] without differentiating between the warp yarn 2 and the weft yarn 3. In addition, having the intervening protective film 5 makes it possible to push and spread the bundle of carbon fiber filaments 1 without damaging them.

The mechanism for causing the contact body 6 to rotate eccentrically will now be described. The shaft 12 of the motor 14 is connected to an eccentric (i.e., centrally displaced) position of the disc body 20 provided with the lower plate body 18, a bearing 21 (radial bearing) disposed therebetween. The shaft 12 rotates, and thereby causes the disc body 20 to rotate eccentrically. This, in turn, causes the contact body 6 to rotate eccentrically.

Specifically, when the rotating shaft 12 causes the disc body 20 to rotate eccentrically, the lower plate body 18 (and the cushioning material 19) provided to the disc body 20 with the bearing 21 therebetween is intended to rotate eccentrically while remaining positioned orthogonal to the direction in which the fabric 4 is conveyed, as shown in FIG. 1. However, being connected to the upper plate body 16 by the interposed elastic supporting columns 17, the lower plate body 18 is subject to an elastic restoring force generated by the supporting columns 17 and rotates eccentrically while vibrating tightly in a radial direction (in the direction of the plane of the fabric 4). Although one cushioning material 19 is provided in the configuration according to the first working example, a plurality of cushioning materials 19 may be provided instead.

The protrusion 8 is thereby caused to press against a yarn in a direction oblique to the axial direction of each of the carbon fiber filaments 1, and the top portion of the protrusion 8 caused to rub against the yarn while vibrating, thereby enhancing the effect of pushing and spreading each of the carbon fiber filaments away from one another.

In the first working example, the upper plate body 16 is provided to a suitable supporting member (not shown), and is provided in a stationary state relative to the conveyed fabric 4. The motor body 13 is provided in a fixed state on the upper plate body 16. Specifically, the upper plate body 16 is fixed (as is the contact body 6) so as to be disposed orthogonal to the direction in which the fabric 4 is conveyed.

Figure 4:
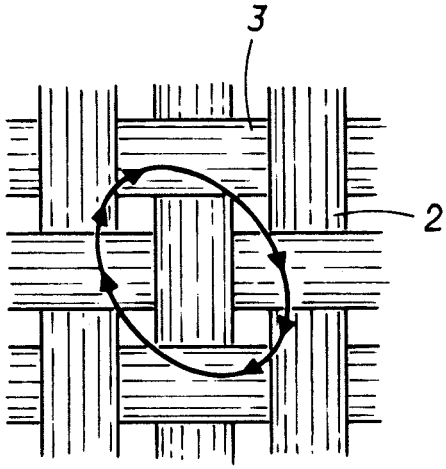
FIG. 4 is a schematic drawing showing a path of movement of a protrusion in another embodiment of the first working example.

Although in the first working example the upper plate body 16 and the motor body 13 (i.e., the contact body 6) are provided in a stationary state relative to the fabric 4, the contact body 6 may be configured to move tightly in a reciprocating manner in a direction oblique to the direction in which the fabric 4 is conveyed at the same time as when it is caused to rotate eccentrically. In such an instance, the contact body 6 follows an elliptical path, as shown in FIG. 4. As in the first working example, the contact body 6 in such an instance again moves in a direction oblique to the longitudinal direction of the warp yarn 2 and the weft yarn 3, allowing the fabric to be opened satisfactorily.

Although the protrusion 8 used in the first working example is made of stainless steel, the presence of the cushioning material 19 and the supporting columns 17, which are elastic, results in the cushioning material 19 and the supporting columns 17 absorbing the pressing force even if the protrusion 8 is pressed against the surface of the fabric 4 with appreciable force. Therefore, the rounded top portion of the protrusion 8 can be rubbed onto the fabric 4 with a force that is sufficient for the fabric 4 to be opened satisfactorily, and the likelihood of the fabric 4 being damaged is minimized.

Figure 5:
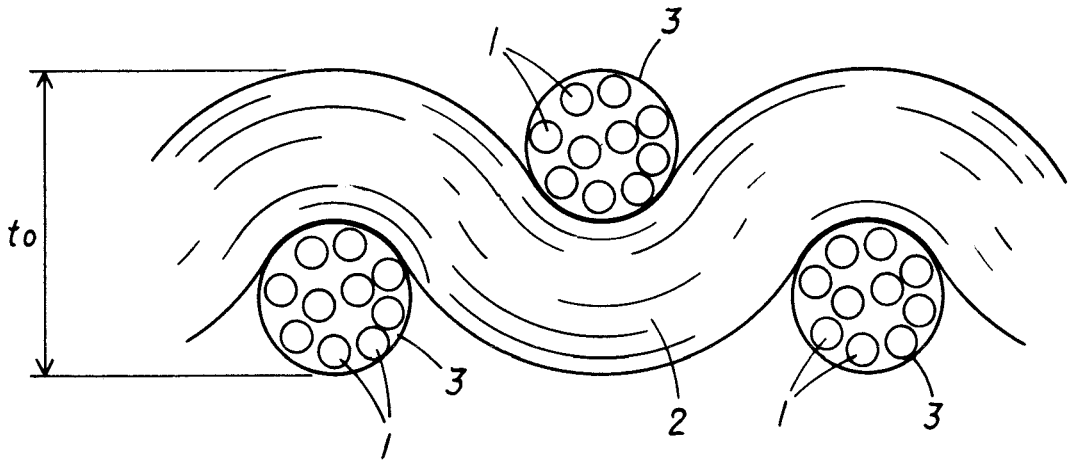
FIG. 5 is a schematic cross-section view of a fabric before being opened.
Figure 6:
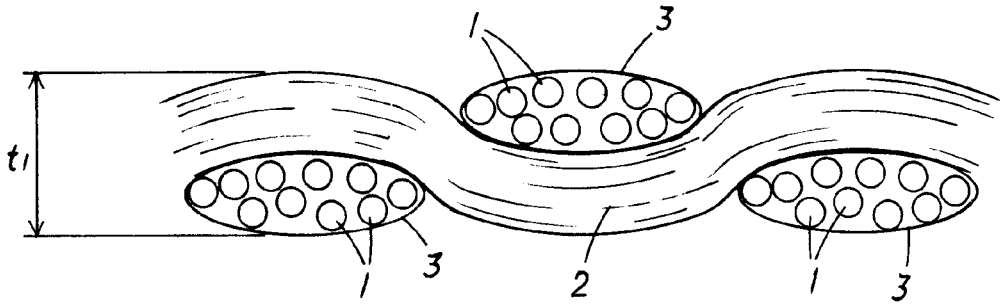
FIG. 6 is a schematic cross-section view of a fabric after being opened.

When the contact body 6 configured as above is used, the fabric 4 appearing in the state shown in FIG. 5 (a state upstream relative to the contact body 6 with respect to the direction in which the fabric 4 is conveyed, in FIG. 1) can be opened so that the fiber filaments 1 in the warp yarns 2 and the weft yarns 3 are not unevenly distributed, as shown in FIG. 6. Also, the contact body 6 obliquely pushes and spreads the warp yarn 2 and the weft yarn 3 in the areas next to intersecting regions of the warp yarn 2 and the weft yarn 3, making it possible to correspondingly push and spread the intersecting region (in particular, sections of a yarn that is overlapped by the other yarn). A flat fabric that has been opened so that the thickness $t_0$ is reduced to a thickness $t_1$ (a state downstream relative to the contact body 6 in the direction in which the fabric 4 is conveyed, in FIG. 1) can thereby be obtained. It is also possible to obtain a fabric 4 in which voids enclosed by warp yarns 2 and the weft yarns 3 are as small as possible, such as a fabric 4 having a cover factor of 96% or higher. Therefore, having the contact body 6 contact the fabric 4 while the fabric 4 is conveyed allows the whole of the fabric 4 to be continuously opened in a satisfactory manner. Also, composite materials formed using the fabric 4 will be lightweight and have high strength after being set because the fabric 4 will be uniformly impregnated with a resin such as an epoxy resin.

Specifically, composite materials obtained by using the fabric 4 as a base material and having it impregnated with a resin to achieve a composite structure are uniformly impregnated with the resin, and therefore exhibit adequate flexural strength, interlaminar shear strength, and other attributes. In other words, in a fabric that has been impregnated with the resin, the fiber section where the warp yarn and the weft yarn (or both) are present will have high strength due to the presence of the fiber and the resin, but no fiber will be present in a gap section enclosed by the warp and weft yarns where only the resin is present, and the gap section will be more brittle than the fiber section in which both the fiber and the resin are present. Therefore, in comparison to a fabric having a small cover factor (i.e., a loosely woven fabric), a fabric with a large cover factor (i.e., a densely woven fabric, or one that has been opened) has a smaller proportion of the brittle gap sections and a larger proportion of the strong fiber sections, therefore exhibiting adequate flexural strength, interlaminar shear strength, and other attributes.

Although it is possible to increase the density of the number of warp and weft yarns and thereby obtain a densely woven fabric (a fabric with a large cover factor before being opened), increasing the density of the number of warp and weft yarns increases the degree to which the yarns bend in the direction of their respective cross-sections, leading to a diminished rate of yarn strength development. This is because the yarn strength development is larger when the yarn is closer to being straight, with less bending in the cross-sectional direction.

In this respect, according to the present working example, opening a fabric that has an adequate cover factor makes it possible to obtain a composite material having yarns with minimal bending and a suitable yarn strength development. As a result, composite materials having the fabric according to the present invention will be highly useful when used for aircraft materials and other suitable products. The density of the number of yarns refers to the number of yarns present within a given distance.

Figure 7:
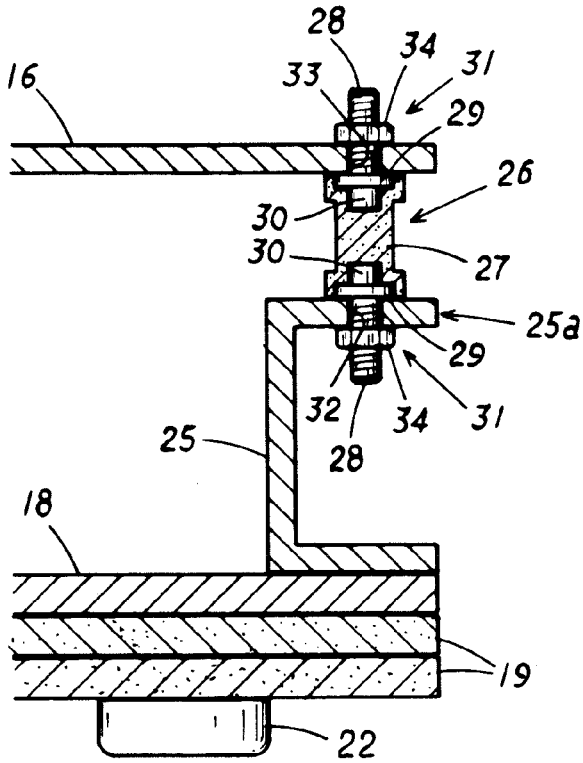
FIG. 7 is an expanded schematic cross-section view of a specific configuration according to the first working example.

The connecting structure between the contact body 6, the upper plate body 16, and the supporting columns 17 shown in FIG. 1 is conceptual. An example of a specific connecting structure that may be used is shown in FIG. 7, comprising a supporting plate body 25 having a C-shape as viewed from the side provided to each end portions of the upper surface of the lower plate body 18 so as to open outwards, and an elastic member 26, corresponding to the supporting column 17, provided between an upper horizontal plate portion 25*a* of the supporting plate body 25 and each end portion of a lower surface of the upper plate body 16. The elastic member 26 comprises a rubber body 27, there being embedded above and below the rubber body 27 a flange portion 29 and an end portion 30 of a connecting body 31 comprising the flange portion 29 and the end portion 30 as well as a threaded portion 28. Therefore, the threaded portion 28 of the connecting body 31 embedded in the lower portion of the body 27 of the elastic member 26 is screwed into a screw hole 32 in the upper horizontal plate portion 25*a* of the supporting plate body 25, and the threaded portion 28 of the connecting body 31 embedded in the upper portion of the body 27 is screwed into a screw hole 33 on each of the two end portions of the upper plate body 16, whereby the contact body 6 is connected to the upper plate body 16 with an elastic body disposed therebetween. Numeral 34 in the drawing indicates a nut.

As a result of the elastic member 26 being present, even if the surface of the fabric 4 is pressed with an appreciable level of strength, the elastic member 26 will absorb any excess pressing force, so that an appropriate pressing force is applied on the fabric 4. Accordingly, the rounded top portion of the protrusion 8 can be rubbed onto the fabric 4 with a force that is sufficient for the fabric 4 to be opened satisfactorily, and the likelihood of the fabric 4 being damaged is minimized.

In the first working example, the contact body 6 is caused to rotate eccentrically and thereby open the fabric 4, as described above; however, in an alternative embodiment, the contact body 6 is caused to move in a reciprocating manner in a direction oblique to the direction in which the fabric 4 is conveyed (lengthwise direction), and thereby caused to move orthogonally in the longitudinal direction of the warp yarn 2 or the weft yarn 3 (second working example).

Figure 8:
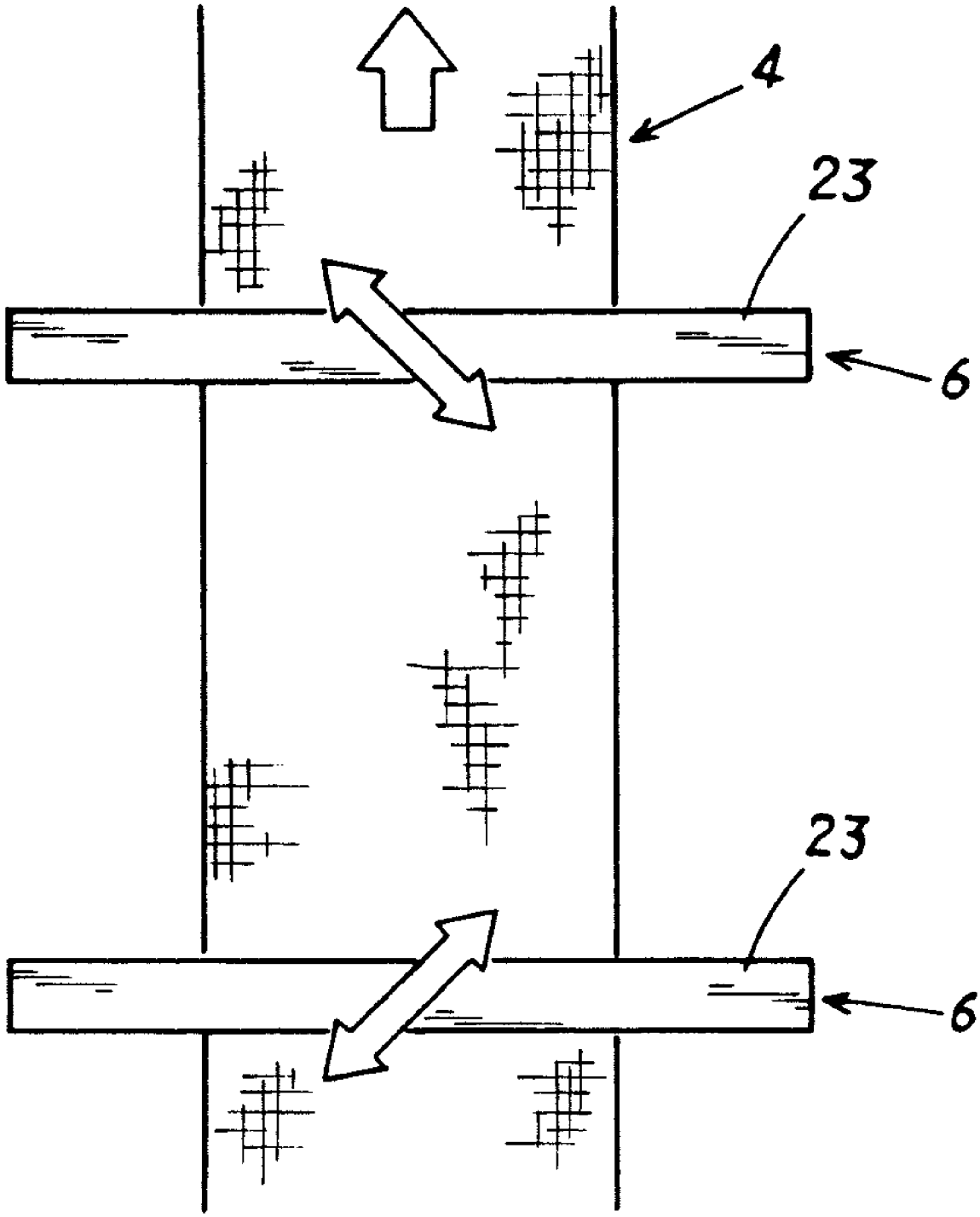
FIG. 8 is a schematic top view of a second working example.

Specifically, two contact bodies 6 provided orthogonally relative to the direction in which the fabric 4 is conveyed as shown in FIG. 8 are caused to move in a reciprocating manner in mutually orthogonal directions that are oblique to the direction in which the fabric 4 is conveyed, thereby causing each of the contact bodies 6 to move obliquely in the longitudinal direction of the warp yarn 2 and the weft yarn 3.

Figure 9:
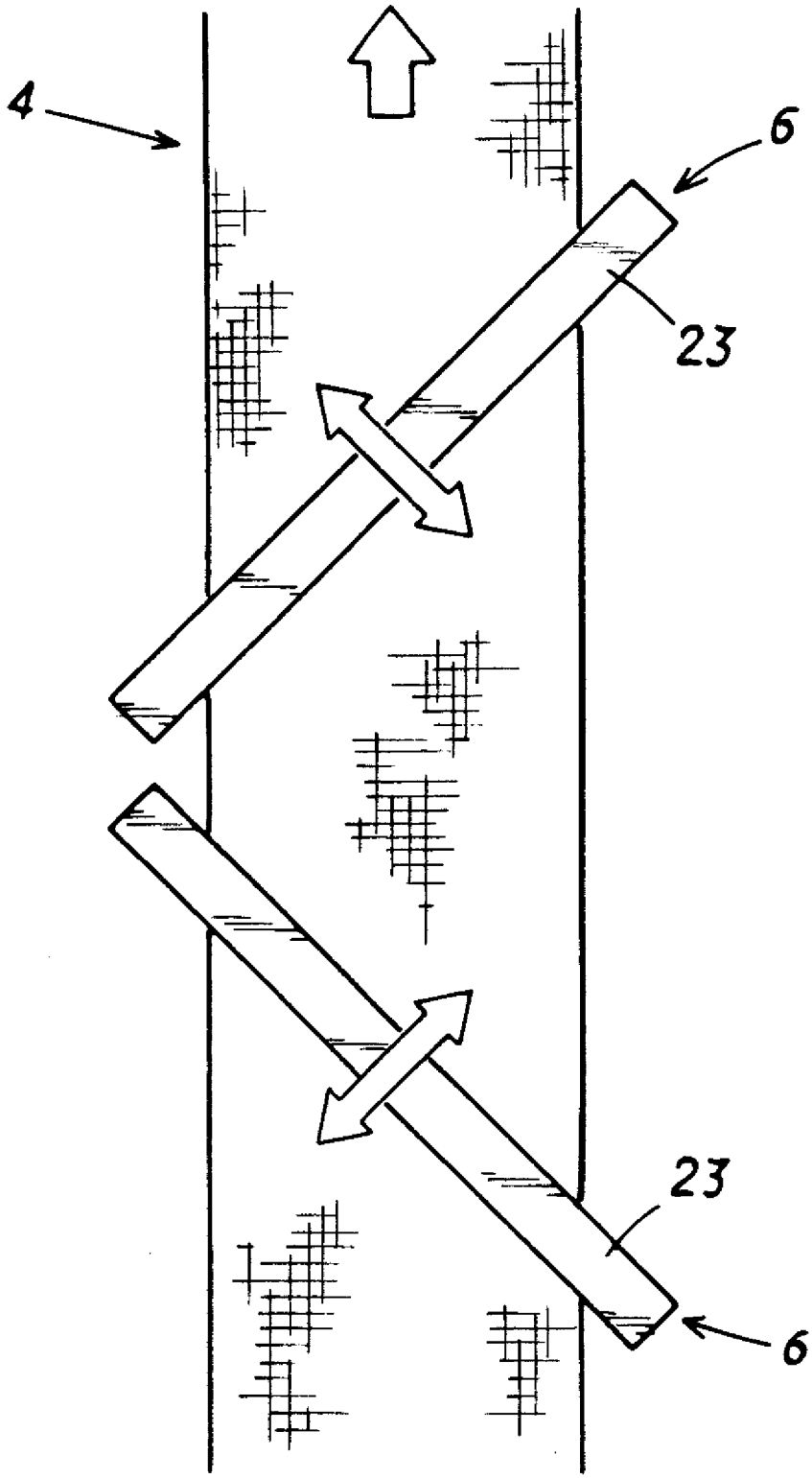
FIG. 9 is a schematic top view of another example of the second working example.

Alternatively, the contact body 6 may be configured in another example, as shown in FIG. 9, so that two contact bodies 6 are provided in mutually orthogonal directions that are oblique to the direction in which the fabric 4 is conveyed, and the contact bodies 6 are caused to move in a reciprocating manner in mutually orthogonal directions that are oblique to the direction in which the fabric 4 is conveyed, thereby causing each of the contact bodies 6 to move obliquely in the longitudinal direction of the warp yarn 2 and the weft yarn 3.

The purpose of providing two contact bodies 6 and having them move in a reciprocating manner in mutually orthogonal directions is to open the fabric as uniformly as possible. As with the first working example, such configurations also allow the fabric to be opened satisfactorily.

In the second working example, the direction in which the contact body 6 moves in a reciprocating manner (direction of vibration) is set to ±45° relative to the direction in which the fabric 4 is conveyed, assuming the warp density and weft density to be in a 1:1 ratio; however, the direction of reciprocating movement is adjusted to suit the ratio between the warp density and weft density. For example, in an instance where the warp density is high and the weft density is low, the direction of reciprocating movement is preferably set to ±30° [relative to the fabric direction].

Figure 10:
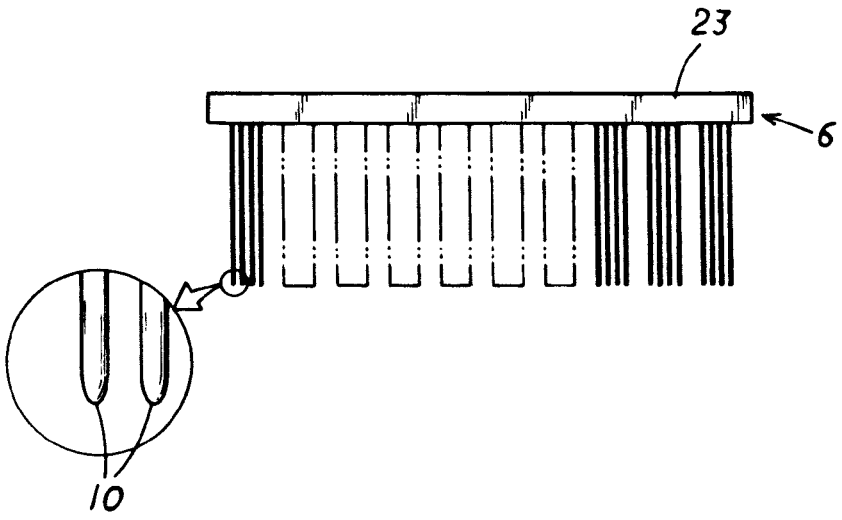
FIG. 10 is a schematic side view of a contact portion of a contact body according to the second working example.
Figure 11:
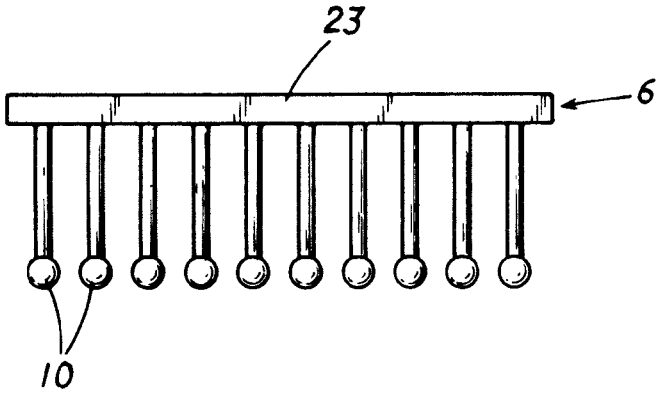
FIG. 11 is a schematic side view of a contact portion of a contact body according to the second working example.
Figure 12:
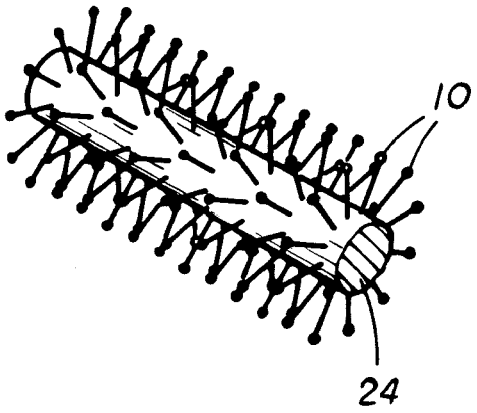
FIG. 12 is a schematic perspective view of a contact portion of a contact body according to the second working example.

In each of the examples shown in FIGS. 8 and 9, rather than providing protrusions 8 to the contact portion, reasons relating to enabling the fabric to be opened uniformly make it more desirable for numerous fine rod-shaped elastic bodies 10 having a length of about 10 to 20 mm to be disposed vertically on a board material 23 as shown in FIG. 10, a large number of rod-shaped bodies 10 having a length of about 10 to 20 mm to be disposed vertically on a board material 23 as shown in FIG. 11, or a large number of rod-shaped bodies 10 having a length of about 10 to 20 mm to be disposed vertically on a peripheral surface of a shaft 24 as shown in FIG. 12.

Specifically, FIG. 10 shows an example in which each of the fine rod-shaped bodies 10 is rounded on a distal end with a radius of between 1 and 2 mm, and each of FIGS. 11 and 12 shows an example in which a spherical portion having a radius of between 1 and 2 mm is provided on a distal end of each of the rod-shaped bodies 10. Each of the rod-shaped bodies 10 in FIG. 12 may be rounded on a distal end with a radius of between 1 and 2 mm. In such an instance, adjusting the pressing force against the fabric 4 or another variable makes it possible to spread the warp yarn 2 and the weft yarn 3 satisfactorily. When the rod-shaped bodies 10 are used, there is no need to cause an eccentric rotation described earlier. Therefore, in each of the examples shown in FIGS. 10 and 11, it is possible merely to provide the rod-shaped bodies 10 to the board material 23, and provide a movement mechanism for moving the board material 23 in a predetermined direction in a linear, reciprocating manner; in the example shown in FIG. 12, it is possible merely to provide the rod-shaped bodies 10 on the shaft 24, and provide a movement mechanism for rotating the shaft 24.

According to the present example, and as described above, the contact body 6 made to contact the surface of the fabric 4 with the protective film 5 interposed therebetween is caused to move obliquely in the longitudinal direction of the warp yarn 2 and the weft yarn 3, thereby pressing the warp yarn 2 and the weft yarn 3 under the application of a force thereon so that each of the bundles of fiber filaments 1 constituting the warp yarn 2 and the weft yarn 3 is pushed and spread, so that the yarns are spread. The warp yarn 2 and the weft yarn 3 can be spread with a smaller pressing force, thereby correspondingly reducing the likelihood of the warp yarn 2 and the weft yarn 3 being damaged. Also, application of a force for pushing and spreading each of the bundles of fiber filaments 1 allows intersecting regions of the warp and weft yarns, which cannot be pushed and spread directly, to be pushed and spread in concert with the areas next to the intersecting regions, so that the fabric can be opened satisfactorily.

According to the first working example, the contact body 6 is made to contact and slide against the fabric 4 while being caused to rotate eccentrically, and a force is applied so that each bundle of fiber filaments are pushed and spread. This makes it possible to continuously apply the pushing and spreading force more uniformly and over a wider area, and exceptionally high efficiency is obtained. Also, since the contact body 6 is caused to rotate eccentrically over the fabric 4 while being made to vibrate tightly in a radial direction, the vibration further improves the quality of the opening process and allows the opening to be performed with exceptionally high efficiency.

Also, a fabric 4 that has been woven using a normal loom can be subjected to the opening process without any intervening steps, eliminating any need to introduce any new equipment, and the cost is correspondingly reduced. Also, in contrast to methods involving opening the fabric by immersing in a solvent or another substance, no sizing agent is removed, so that the fabric can be handled as easily as a conventional fabric, and no fluff forms.

Accordingly, the present working example makes it possible to obtain a flat fabric in which the warp and weft yarns are spread uniformly, makes it possible to obtain a fabric with minimal gaps between yarns, and makes it possible to use the fabric as a base material to obtain a composite material capable of exhibiting sufficient strength such as that demanded in the field of aircraft materials.

An example of an experiment confirming the effects of the present example will now be described.

As shown in FIG. 13, a fabric woven from warp and weft yarns of bundled carbon fiber filaments (number of filaments: 6000, fineness: 400 tex) was used to obtain a first comparative example, in which the fabric was unopened; a second comparative example, in which the fabric was opened using ultrasound; the first working example, in which the fabric was opened using a contact body that is caused to rotate eccentrically as described above; and the second working example, in which the fabric is opened using a contact body caused to move in a linear, reciprocating manner at ±45° as described above. The fabric from each of the examples was measured for its cover factor, examined for fluff, and assessed in terms of handleability. The fabric from each of the examples was also uniformly impregnated with a typical epoxy resin and partially set to form a pre-preg, eight sheets of which were layered and set to form a composite material. The flexural strength and the interlaminar shear strength (ILSS) of each of the composite materials were then measured.

The cover factor was measured using a void ratio measuring apparatus, such as that disclosed in Japanese Laid-open Patent Publication No. 2005-290623. Measurements were taken of the void ratio (i.e., the ratio of the total area of void portions to the total area of an area being measured) in a fabric comprising warp and weft yarns and used for a fiber reinforced resin, the void portions being enclosed by the warp and weft yarns. The measurement apparatus was a scanner comprising a light-emitting part and a light-receiving part for receiving light emitted by the light emitting part. The light-emitting part and the light-receiving part were disposed so that the fabric used for the fiber reinforced resin was positioned therebetween, each of the light-emitting part and the light-receiving part configured to move synchronously. The fabric was visually examined for fluff. The handleability was assessed in regard to the workability of the fabric when creating the pre-preg; specifically, the frequency at which fluff was removed and the existence of any irregular gaps between the yarns.

Figure 14:
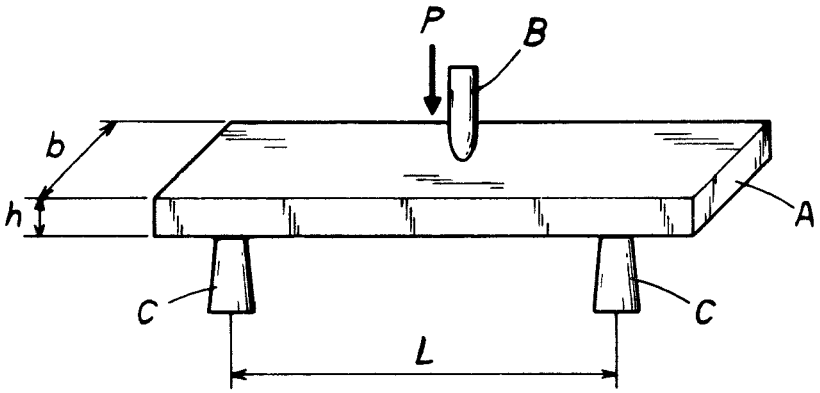
FIG. 14 is a schematic drawing of the flexural strength test and the interlaminar shear strength test.

The flexural strength and the interlaminar shear strength were each measured using the test shown in FIG. 14, where a load P was applied to a sample A using an indenter B, a predetermined value having been set for a distance L between supporting points each supported by a supporting body C.

Specifically, the flexural strength was tested using a three-point bending test according to JIS K7074, using a sample with a thickness of 2±0.4 mm, a width of 15±0.2 mm, and a length of 100±1 mm. Test conditions were set so that the distance between the supporting points was 80±0.2 mm and the test speed was 1 mm/min. The formula $(3*P*L)/(2*b*h^2)$ was used to determine the flexural strength. The interlaminar shear strength was tested using a three-point test according to JIS K7078, using a sample with a thickness between 1.8 mm and 4.2 mm, a width of 10.0±0.2 mm, and a total length that was seven times the sample thickness. The test conditions were set so that the distance between the supporting points was five times the sample thickness and the test speed was 1 mm/min. The formula $(3/4)*P/(b*h)$ was used to obtain the interlaminar shear strength. Here, P represents the load (N), L represents the distance between the supporting points (mm), b represents the width of the sample piece (mm), and h represents the thickness of the sample piece (mm).

A comparison between the results for the first and second comparative examples showed that although opening the fabric using ultrasound improved the cover factor, and correspondingly improves the flexural strength and interlaminar shear strength of the resulting composite material by a moderate degree, the fabric opened using ultrasound exhibited fluff formation, and showed no improvement in terms of handleability. The interlaminar shear strength in the second comparative example was somewhat higher than that in the first comparative example because the fabric in the second comparative example had high flatness. In other words, the cover factor was high, meaning that the yarns assumed a flattened shape, and the fibers were thereby distributed throughout a unit area so that there were no gaps. This suggests that the ability of the fabric to be wetted and permeated by the resin was improved, so that the resin uniformly impregnated the fabric, and strength required for a composite material was exhibited.

The first and second working examples showed that the cover factor could be maximally increased without evidence of fluff formation noted in the second comparative example, and the fabric could be more readily handled. Moreover, the flexural strength and the interlaminar shear strength of the resulting composite material were improved by a greater proportion than with the second comparative example.

The invention claimed is:

1. A method for opening a fabric in which a fabric produced by weaving a warp yarn and a weft yarn, each having a bundled plurality of fiber filaments, is opened; the method for opening a fabric characterized in that a contact body is provided to a surface of the fabric with a protective film interposed therebetween; the contact body is provided with a contact portion for contacting a surface of the fabric with the protective film interposed therebetween, a protrusion having a convex ridge being provided to the contact portion in an annular configuration; and the contact body is caused to move over the fabric obliquely, and in a relative manner, while being caused to vibrate and rotate in an eccentric fashion, thereby spreading the warp yarn or the weft yarn.

2. The method for opening a fabric according to claim 1, characterized in that the contact body is caused to move in a relative manner with respect to the fabric.

3. The method for opening a fabric according to claim 2, characterized in that the fabric is conveyed.

4. The method for opening a fabric according to claim 1, characterized in that the fiber filaments are inorganic fiber filaments.

5. The method for opening a fabric according to claim 4, characterized in that the inorganic fiber filaments are carbon fiber filaments.

6. The method for opening a fabric according to claim 1, characterized in that the fiber filaments are organic fiber filaments.

7. A fabric characterized in being opened using the method for opening a fabric according to any of claims 1 through 6.

8. The fabric according to claim 7, characterized in having a cover factor of 96% or higher.

9. A composite material characterized in comprising the fabric according to claim 8 being used as a base material, and the base material being impregnated with a resin, and an interlaminar shear strength of the composite material is greater than or equal to 75 Mpa.

* * * * *

UNITED STATES PATENT AND TRADEMARK OFFICE

CERTIFICATE OF CORRECTION

PATENT NO. : 8,161,607 B2
APPLICATION NO. : 12/671306
DATED : April 24, 2012
INVENTOR(S) : Masaaki Hirai and Akihiko Machii It is certified that error appears in the above-identified patent and that said Letters Patent is hereby corrected as shown below:

Column 2, Line 53: delete “first” and insert -- fourth --

Column 2, Line 57: delete “fourth” and insert -- first --

Signed and Sealed this
Twenty-seventh Day of November, 2012

David J. Kappos

David J. Kappos
*Director of the United States Patent and Trademark Office*